US007946871B1

(12) United States Patent
Yu et al.

(10) Patent No.: US 7,946,871 B1
(45) Date of Patent: May 24, 2011

(54) ELECTRICAL CONNECTOR AND ELECTRICAL CONNECTOR ASSEMBLY HAVING STRUCTURES FOR PREVENTING ARC-DISCHARGE

(75) Inventors: Wang-I Yu, Jhonghe (TW); Hung-Chi Tai, Jhonghe (TW); Yung-Chih Hung, Jhonghe (TW)

(73) Assignee: Alltop Electronics (Suzhou) Co., Ltd, Taicang, Jiangsu Province (CN)

( * ) Notice: Subject to any disclaimer, the term of this patent is extended or adjusted under 35 U.S.C. 154(b) by 0 days.

(21) Appl. No.: 12/832,734

(22) Filed: Jul. 8, 2010

(30) Foreign Application Priority Data

Mar. 11, 2010 (CN) ..... 2010 1 0148703

(51) Int. Cl.
*H01R 13/53* (2006.01)

(52) U.S. Cl. ..... 439/181; 439/660; 439/886

(58) Field of Classification Search ..... 439/181, 439/660, 886
See application file for complete search history.

(56) References Cited

U.S. PATENT DOCUMENTS 4,747,783 A * 5/1988 Bellamy et al. ..... 439/59
6,537,091 B2 * 3/2003 Hirai et al. ..... 439/181
6,918,800 B2 * 7/2005 Ota et al. ..... 439/886
7,163,753 B2 * 1/2007 Ota et al. ..... 428/647
7,452,249 B2 * 11/2008 Daily et al. ..... 439/825

FOREIGN PATENT DOCUMENTS

EP 1 703 597 A1 9/2006

* cited by examiner

*Primary Examiner* — Tho D Ta

(74) *Attorney, Agent, or Firm* — Sughrue Mion, PLLC

(57) ABSTRACT

An electrical connector in accordance with the present invention includes an insulative housing defining a mating direction and at least one contact-receiving passage extending along a mating direction, at least one conductive contact received in the at least one contact-receiving passage for electrically connecting with a conductive contact of a complementary connector, and a protection element. The at least one conductive contact includes a retention section interferentially received in the at least one contact-receiving passage, and a mating section extending from the retention section for electrically connecting with corresponding conductive contact of the complementary connector, and a mounting section extending from the retention section. The mating section forms a tip end at a free end thereof. The protection element is integrally formed with the tip end of the mating section of the at least one conductive contact and wraps the tip end.

14 Claims, 8 Drawing Sheets

ELECTRICAL CONNECTOR AND ELECTRICAL CONNECTOR ASSEMBLY HAVING STRUCTURES FOR PREVENTING ARC-DISCHARGE

CROSS-REFERENCE TO RELATED APPLICATIONS

This application is related to U.S. patent application Ser. No. 12/832,526 filed on Jul. 8, 2010, entitled "ELECTRICAL CONNECTOR AND ELECTRICAL CONNECTOR ASSEMBLY HAVING STRUCTURES FOR TOUCH-SAFETY", which claims priority to Chinese Application Nos. 201010162786.9 filed Apr. 7, 2010 and 201010162754.9 filed Apr. 7, 2010. The disclosure of the related applications are incorporated herein by reference.

BACKGROUND OF THE INVENTION

1. Field of the Invention

The present invention relates to an electrical connector and an electrical connector assembly, more particularly to an electrical connector and an electrical connector assembly for power transmission.

2. Description of Related Art

Electrical connectors are widely used today. In general, electrical connectors can be classified into personal use and industrial use. When in personal use, electrical connectors can be classified as desktop connectors, laptop connectors, mobile phone connectors, consuming connectors, and other types. When in industrial use, electrical connectors can be used in industrial computers, servers, and workstations. Power connector is one common kind electrical connector used in different equipments. Usually, a plug-type power connector and a receptacle-type power connector mate with each other to supply power to equipments. Contacts of the plug and the receptacle contact one another to form electrical connection. When the power connectors are used in industrial circumstances, current loaded on the power connectors are much bigger than in personal use. When the mated power receptacle connector and the power plug connector mate with each other or disconnect from each other with current, conductive contacts of the power connectors generate arc-discharge phenomenon therebetween. Therefore, contacting portions of the contacts may produce carbon, melt, and excessive deformation etc., even potential dangers.

In fact, the generation of the arc-discharge phenomenon is because contacts are made from stamping and cutting technologies which form sharp edges on tip ends of the contacts. These sharp edges of the contacts generate arc-discharge phenomenon. Please refer to FIGS. 1 and 2, the theory of the generation of the arc-discharge between conventional power plug connector and power receptacle connector is disclosed. A plug connector 1' and a receptacle connector 2' are capable of mating with each other. The plug connector 1' comprises a first insulative housing 10' and a plurality of first contacts 11' assembled in the first insulative housing 10'. The receptacle connector 2' comprises a second insulative housing 20' and a plurality of second contacts 21' assembled in the second insulative housing 20'. Each first contact 11' has a first sharp edge 110' formed during stamping process by a stamping die and each second contact 21' has a second sharp edge 210' formed during stamping process by a stamping die. When the first and second sharp edges 110', 210' are close to each other in a certain distance during mating or disconnecting processes, arc is generated, that is an arc-discharge phenomenon we discussed above. In general, the sharper the sharp edges are, the more serious the arc-discharge phenomenon is, therefore more dangerous to reliable power transmission of power connectors. However, sharp edges are unavoidable for contacts manufactured by stamping and cutting technologies.

Hence, it is disable to design an electrical connector to address problems mentioned above.

BRIEF SUMMARY OF THE INVENTION

Accordingly, an object of the present invention is to provide an electrical connector capable of providing reliable power transmission.

Another object of the present invention is to provide an electrical connector assembly capable of providing reliable power transmission.

In order to achieve the above-mentioned object, an electrical connector adapted for electrically connecting with a complementary connector comprises an insulative housing defining a mating direction and at least one contact-receiving passage extending along the mating direction, at least one conductive contact received in the at least one contact-receiving passage adapted for electrically connecting with a conductive contact of the complementary connector, and a protection element. The at least one conductive contact comprises a retention section interferentially received in the at least one contact-receiving passage, a mating section extending from the retention section adapted for electrically connecting with corresponding conductive contact of the complementary connector, and a mounting section extending from the retention section. The mating section forms a tip end at a free end thereof. The protection element is integrally formed with the tip end of the mating section of the at least one conductive contact and wraps the tip end.

In order to achieve the above-mentioned object, an electrical connector assembly comprises a first connector defining a mating direction and a second connector electrically connecting with the first connector. The first connector comprises a first insulative housing defining at least one first contact-receiving passage penetrating through the first insulative housing along the mating direction and at least one first conductive contact received in the at least one first contact-receiving passage of the first insulative housing. The at least one first conductive contact comprises a first retention section interferentially received in the at least one first contact-receiving passage, and a first mating section extending from the first retention section and forming a first tip end at a free end thereof. The second connector comprises a second insulative housing defining at least one second contact-receiving passage penetrating through the second insulative housing along the mating direction, and at least one second conductive contact received in the at least one second contact-receiving passage of the second insulative housing and electrically connecting with the at least one first conducive contact. The at least one second conductive contact comprises a second retention section interferentially received in the at least one second contact-receiving passage, and a second mating section extending from the second retention section and forming a second tip end at a free end thereof. A protection element is integrally formed with and wraps one of the first tip end of the first mating section and the second tip end of the second mating section.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
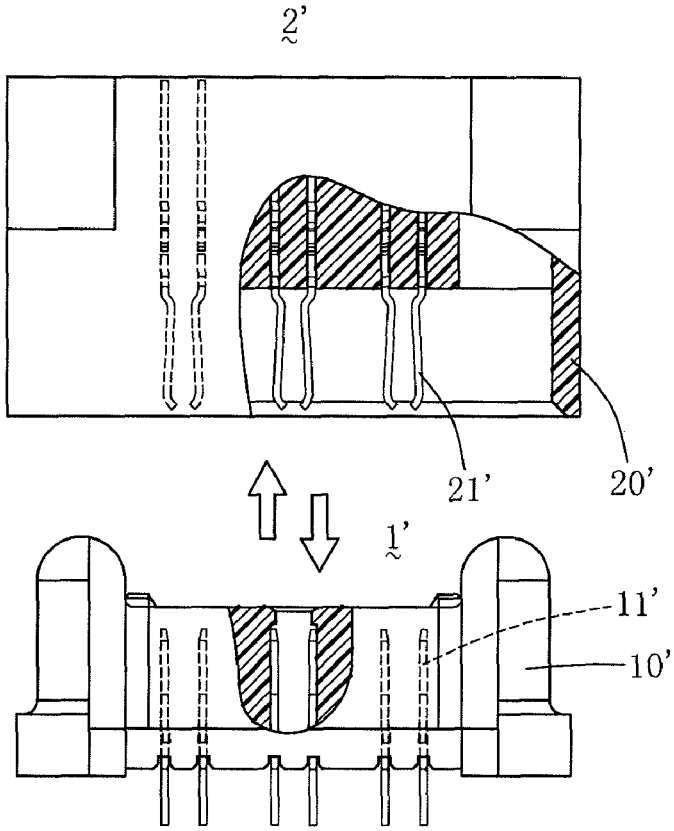
FIG. 1 is a top-elevation, perspective view of a conventional plug connector and a conventional receptacle connector, wherein two groups of contacts are shown in partially cross-sectional view.
Figure 2:
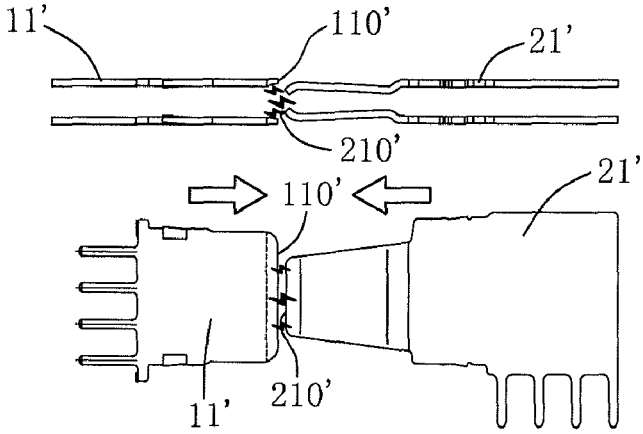
FIG. 2 is a view illustrating how arc is generated between contacts during mating or disconnecting processes.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 3:
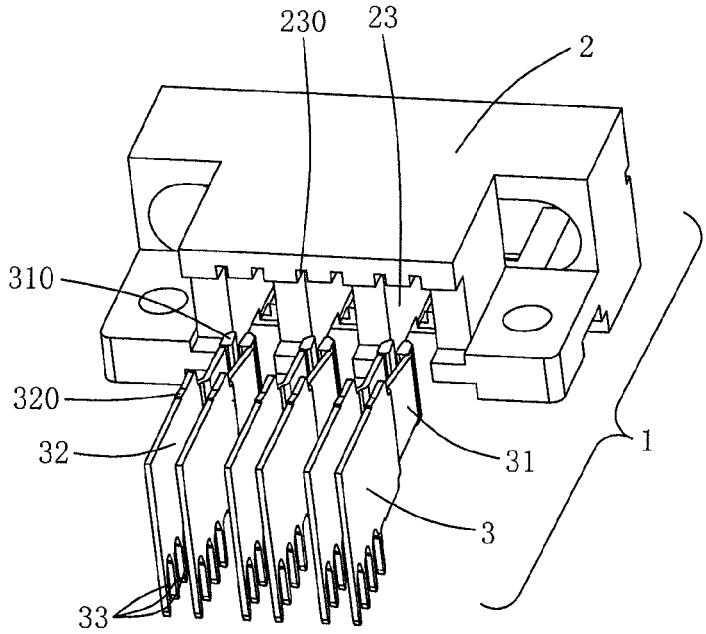
FIG. 3 is an exploded, perspective view of a first connector (electrical connector) in accordance with the present invention.
Figure 4:
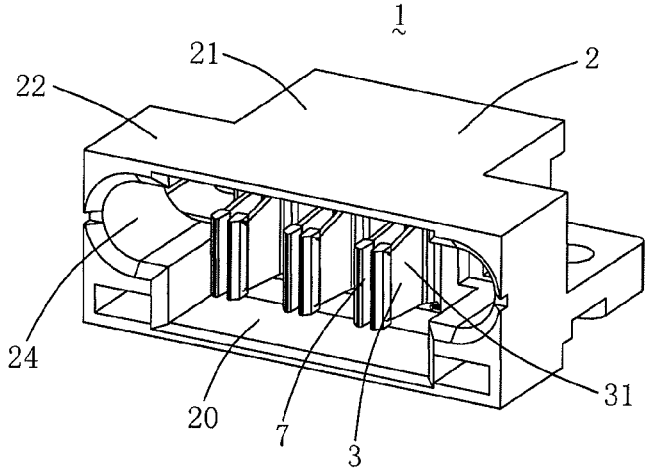
FIG. 4 is an assembled, perspective view of the first connector (electrical connector) in accordance with the present invention.
Figure 5:
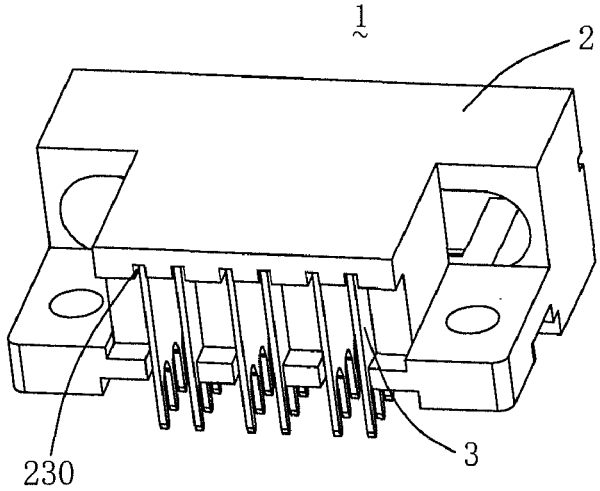
FIG. 5 is an assembled, perspective view of the first connector shown in FIG. 4, but viewed from a different aspect.

Referring to FIGS. 3-5, a first connector 1 in accordance with a preferred embodiment of the present invention is shown. In the preferred embodiment, the first connector 1 is a receptacle connector. As shown in FIG. 3, the first connector 1 comprises a first insulative housing 2 and a plurality of first conductive contacts 3 assembled in the first insulative housing 2.

In the preferred embodiment, the first insulative housing 2 comprises a rectangular rear first base portion 21, and a first mating portion 22 extending forward from the first base portion 21. The first mating portion 22 defines a rectangular hollow receiving space 20. A plurality of first contact-receiving passages 23 penetrates through the first base portion 21 to communicate with the receiving space 20. Each first contact-receiving passage 23 defines a pair of first positioning slots 230 respectively recessed upwardly and downward from a top wall and a bottom wall thereof. The first positioning slots 230 extend along a mating direction and communicate with the receiving space 20. A pair of semi-circular positioning channels 24 are respectively recessed from opposite sidewalls of the first mating portion 22 and communicate with the receiving space 20.

Each first-contact receiving passage 23 receives a pair of first conductive contacts 3 which depart from each other with first mating sections thereof extending toward each other. Each first conductive contact 3 comprises the first mating section 31 exposed into the receiving space 20, a first retention section 32 interferentially received in the first contact-receiving passage 23, and a plurality of first mounting sections 33 exposed beyond a bottom surface of the first base portion 21.

Viewed from height direction, the first mating section 31 and the first retention section 32 are of slice configuration. The first retention section 32 slides along the first positioning slot 230 to assemble the first conductive contact 3 into the first insulative housing 2. A plurality of barbs 320 disposed on upper and lower edges of the first retention section 32 interferentially engage with inner walls of the positioning slots 230 for retaining the first conductive contact 3 into the first insulative housing 2. The first mating section 31 is curved forward from front end of the first retention section 32 and forms a first tip end 310 at a forward free end thereof. In a pair of first conductive contacts 3 which are received in the same first contact-receiving passage 23, the pair of first mating sections 31 are respectively curved inwardly from the pair of first retention sections 32 with the pair of first tip ends 310 thereof curved outwardly first then curved toward each other to face to each other.

Figure 6:
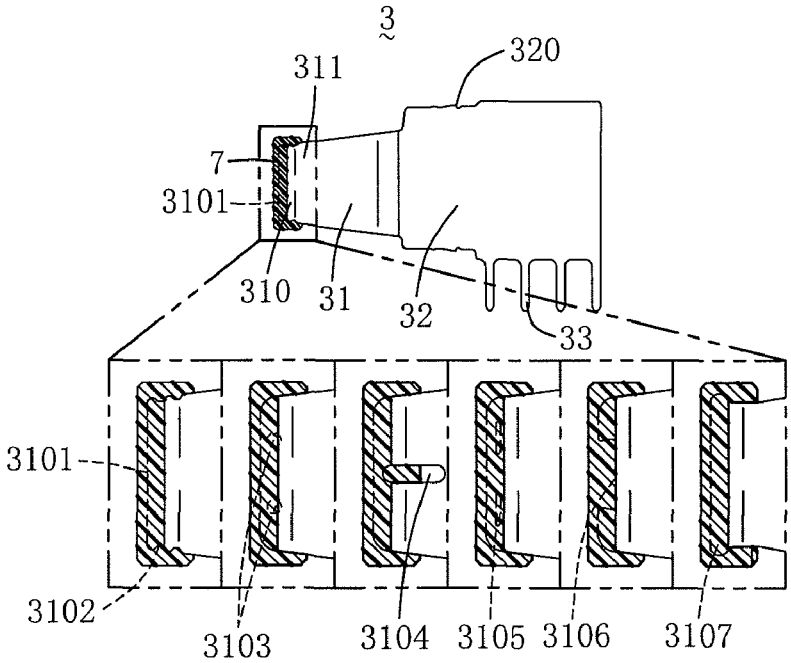
FIG. 6 is a side-elevation view of a first conductive contact of the first connector in accordance with the present invention with different kinds of protection element shown therewith.

Since the first conductive contacts 3 are stamped first by a stamp die then cut to be formed, each first tip end 310 comprises a sharp cutting edge 3101 (FIG. 6). As cited in the prior arts, the sharp cutting edges 3101 cause arc-discharge phenomenon in mating process and thus, cause possible unsafe problems. In the present invention, the first tip end 310 of each first conductive contact 3 is formed with a protection element 7. The protection element 7 is insert-molded with the first tip end 310 to wrap the first tip end 310 in the preferred embodiment of the present invention. In an alternative embodiment, the protection element 7 also can be assembled to the first tip end 310 by mechanical means.

To enhance the retention force between the protection element 7 and the first tip end 310, please refer to FIG. 6, the first tip end 310 is designed with different configurations. From left to right direction in FIG. 6, the first tip end 310 can be equipped with S-shape side edges 3102. The first tip end 310 can have a pair of holes 3103 arranged along up-to-down direction and extending through or recessed in the first tip end 310. The first tip end 310 can have an elliptic-shape recesses 3104 penetrating through or not through the first tip end 310 and extending along the mating direction. The first tip end 310 can have a pair of elongate slots 3105 arranged along up-to-down direction and penetrating through or not through the first tip end 310. The first tip end 310 can have a wedge-shape slot 3106 extending rearward from the sharp cutting edge 3101. The first tip end 310 can have a T-shape formed by a bar 3107 at a front end thereof. Of course, to enhance the retention force between the first tip end 310 and the protection element 7, other means also can be utilized. Each first conductive contact 3 forms a contacting surface 311 behind the protection element 7 and a little higher than the protection element 7 for electrically connecting with a second connector 4. The protection elements 7 in the same group of the first conductive contacts 3 are close to each other.

Figure 7:
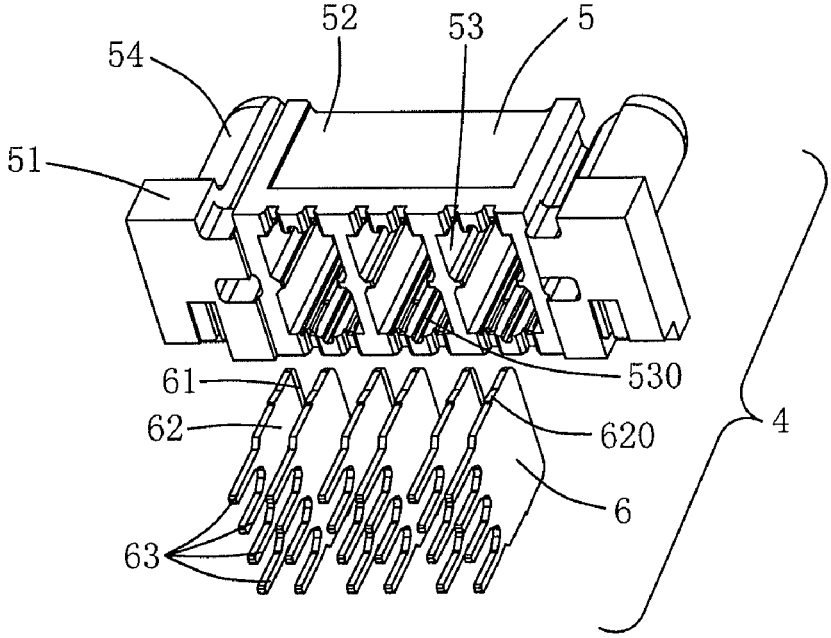
FIG. 7 is an exploded, perspective view of a second connector (electrical connector) in accordance with a first embodiment of the present invention.
Figure 8:
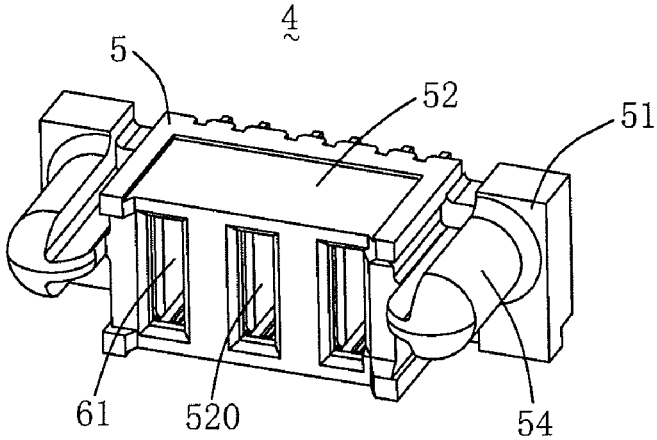
FIG. 8 is an assembled, perspective view of the second connector (electrical connector) in accordance with the first embodiment of the present invention.
Figure 9:
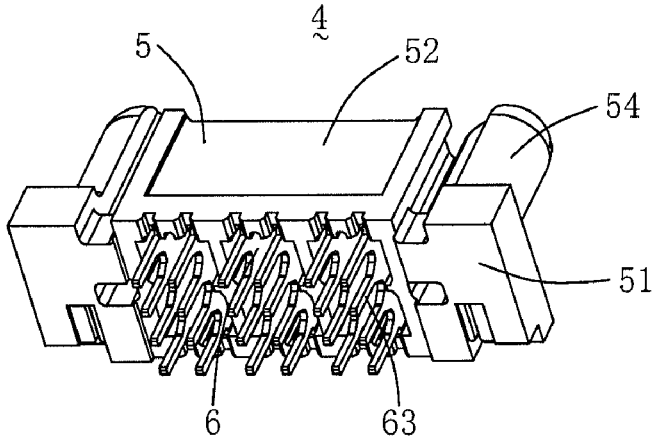
FIG. 9 is an assembled, perspective view of the second connector in FIG. 8, but viewed from a different aspect.

Please refer to FIGS. 7-9, the second connector 4 in accordance with the first embodiment of the present invention is illustrated. As shown in FIG. 7, the second connector 4 comprises a second insulative housing 5 and a plurality of second conductive contacts 6 received in the second insulative housing 5.

The second insulative housing 5 comprises a second base portion 51, a second mating portion 52 extending from a middle section of the second base portion 51, and a pair of column-shape positioning portions 54 located at opposite sides of the second mating portion 52. The positioning portions 54 extend beyond the second mating portion 52 for first mating with the first connector 1 for guiding the first and second connectors 1, 4 to mate with each other properly. The second insulative housing 5 defines a plurality of second contact-receiving passages 53 penetrating through the second base portion 51 and communicating with a receiving cavity 520 defined by the second mating portion 52. Each second contact-receiving passage 53 defines a pair of second receiving slots 530 recessed upwardly and downward from upper and lower walls thereof. The second receiving slots 530 extend along the mating direction till an end surface of the second mating portion 52 for guiding the proper insertion of the second conductive contacts 6 into the second insulative housing 5. The second mating portion 52 defines a rectangular opening in the end surface thereof.

In the first embodiment, the second conductive contact 6 is of a slice configuration, and comprises a flat second mating section 61, a flat second retention section 62 extending rearward from the second mating section 61, and a second mounting section 63 extending from the second retention section 62. When assembling the second conductive contacts 6 in pair into one second contact-receiving passage 53 of the second insulative housing 5, the flat second mating sections 61 are guided by the pair of second positioning slots 530 then extend into the second contact-receiving passage 53 and finally are exposed into the receiving cavity 520. A free end of the second mating section 61 is defined as a second tip end 610. A plurality of barbs 620 are formed on the top and bottom edges of the second retention section 62 to interferentially engage with inner walls of the second positioning slots 530 for increasing the retention force between the second insulative housing 5 and the second conductive contact 6. The second mounting section 63 is exposed beyond a rear face of the second base portion 51 for electrically connecting with other electronic elements.

Figure 10:
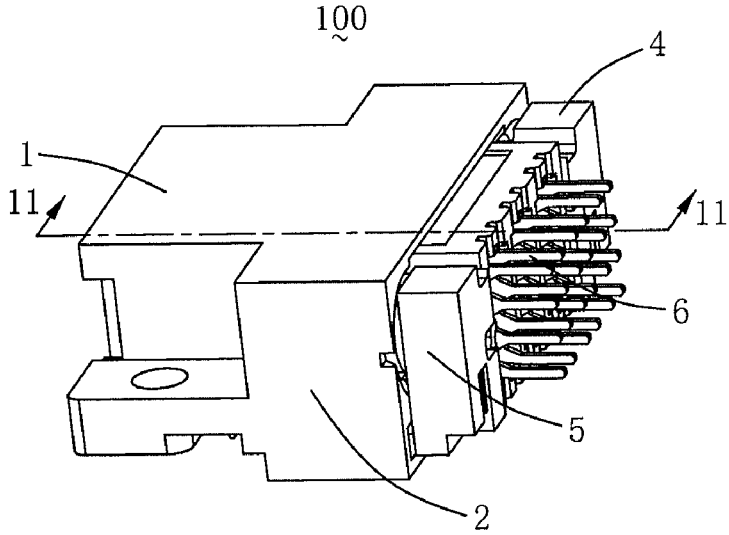
FIG. 10 is an assembled, perspective view of an electrical connector assembly combined by mated first and second connectors in accordance with the first embodiment of the present invention.
Figure 11:
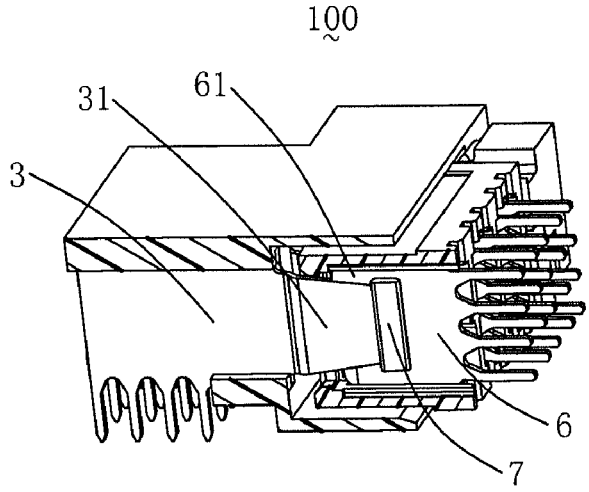
FIG. 11 is a cross-section view taken along line 11-11 of FIG. 10.
Figure 12:
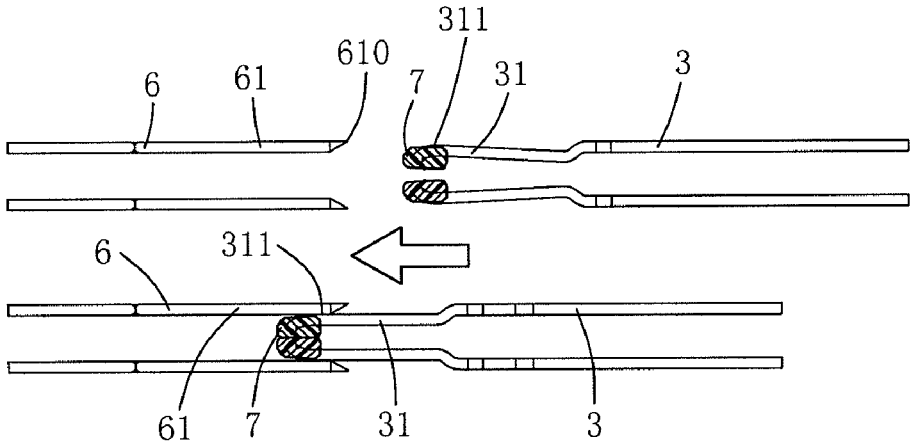
FIG. 12 is a view illustrating how to avoid generation of arc during mating process between one group of the first conductive contacts of the first connector and one group of the second conductive contacts of the second connector.

Please refer to FIGS. 10 to 12, an electrical connector assembly 100 in accordance with the first embodiment of the present invention is formed by mated first connector 1 and the second connector 4. The contacting surfaces 311 of the first conductive contacts 3 in the same group slide along outer surfaces of the second mating sections 61 of the second conductive contacts 6 to form electrical connection therebetween. The first tip ends 310 of the pair of first conductive contacts 3 are elastically compressed by the pair of second mating sections 61 of the second conductive contacts 6 to cause the pair of protection elements 7 contact each other. Since stamping and cutting technologies, the second tip ends 610 of the second mating sections 61 of the second conductive contacts 6 also form shape cutting edges. However, since the first tip ends 310 of the first conductive contacts 6 are wrapped and protected by the protection elements 7, there is no possibility to generate arc-discharge. Different kinds of unsafe problems can be avoided.

Figure 13:
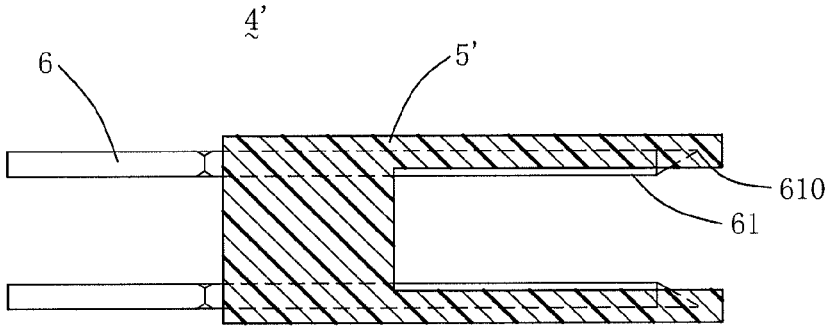
FIG. 13 is a cross-section view of a second connector (electrical connector) in accordance with the second embodiment of the present invention, and wherein a protection element is formed at a second tip end of the second conductive contact.
Figure 14:
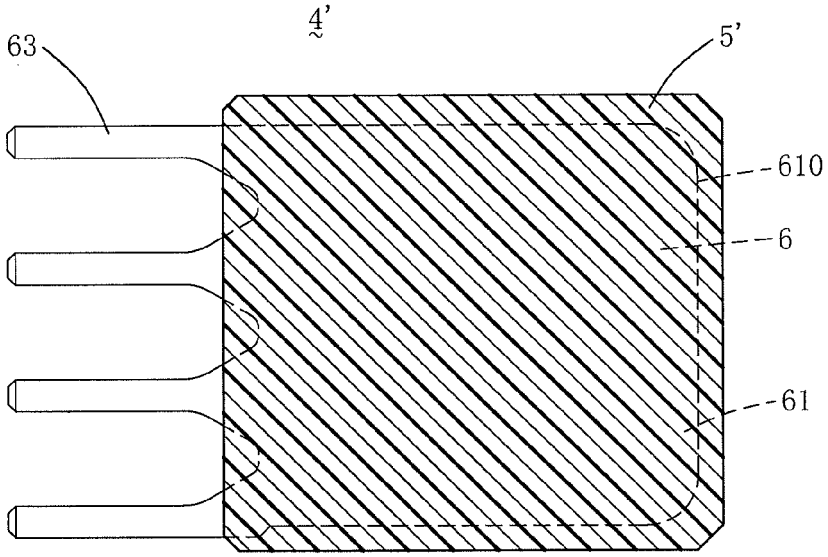
FIG. 14 is a cross-section view of the second connector in accordance with the second embodiment of the present invention from a different aspect.
Figure 15:
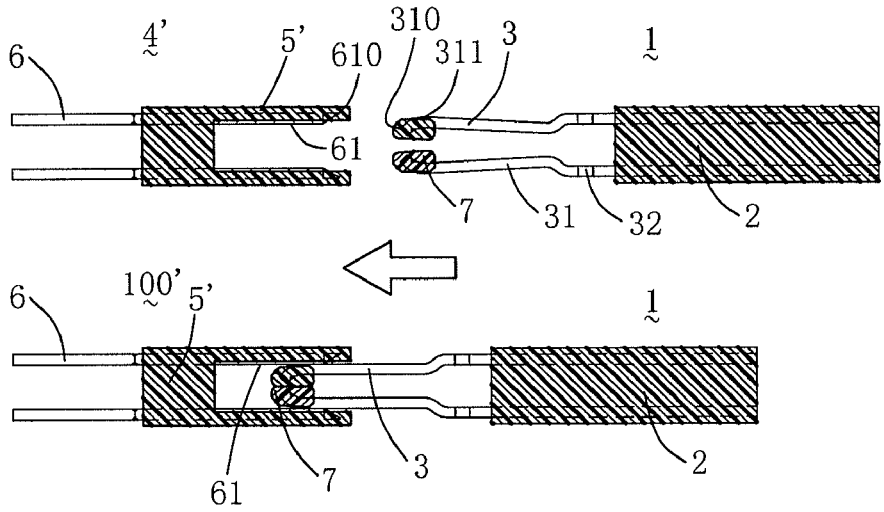
FIG. 15 is a cross-section view of an electrical connector assembly combined by the first and second connectors in accordance with the second embodiment of the present invention.

Please refer to FIGS. 13-15, a second connector 4' in accordance with a second embodiment of the present invention and the mating relationship between the second connector 4' and the first connector 1 are illustrated. Compared with the second connector 4 in the first embodiment, the difference in the second embodiment is each second tip end 610 of the second mating section 61 is wrapped by the second insulative housing 5'. That is to say, part of the second insulative housing 5' which wraps the second tip ends 610 of the second conductive contact 6 is served as a protection element of the present invention. Thus, the second conductive contacts 6 can be assembled to the second insulative housing 5' by mechanical means or can be insert-molded with the second insulative housing 5'. The first tip ends 310 of the first mating sections 31 and the second tip ends 610 of the second mating sections 61 are all wrapped by protection elements, therefore, arc-discharge can be avoided more safely. The protection elements can be made from resin material.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector adapted for electrically connecting with a complementary connector, comprising:

an insulative housing defining a mating direction and at least one contact-receiving passage extending along said mating direction;

at least one conductive contact received in said at least one contact-receiving passage adapted for electrically connecting with a conductive contact of the complementary connector, the at least one conductive contact comprising a retention section interferentially received in the at least one contact-receiving passage, and a mating section extending from the retention section adapted for electrically connecting with corresponding conductive contact of the complementary connector, and a mounting section extending from the retention section, the mating section forming a tip end at a free end thereof; and a protection element integrally formed with the tip end of the mating section of the at least one conductive contact and wrapping the tip end; wherein the at least one conductive contact is a pair of conductive contacts received in the same contact-receiving passage.

2. The electrical connector as claimed in claim 1, wherein the protection element is made from resin material and is insert-molded with the tip end of the at least one conductive contact to wrap the tip end.

3. The electrical connector as claimed in claim 1, wherein the mating section of the at least one conductive contact comprises a contacting surface adapted for forming electrical connection with corresponding conductive contact of the complementary connector, and wherein the contacting surface is located behind the tip end and the protection element.

4. The electrical connector as claimed in claim 1, wherein the tip end of the at least one conductive contact comprises any one of the configurations as: S-shape curved side edges, a pair of holes arranged along up-to-down direction, a recess extending along said mating direction, a pair of elongate slots arranged along said up-to-down direction, a wedge-shape slot extending rearward from a front edge thereof, and a T-shape bar at the front edge thereof.

5. The electrical connector as claimed in claim 1, wherein the at least one conductive contact is of slice configuration, and wherein the retention section forms a plurality of barbs on upper and lower edges for interferentially engaging with inner walls of the at least one contact-receiving passage.

6. The electrical connector as claimed in claim 1, wherein the at least one contact-receiving passage defines a pair of positioning slots recessed upwardly and downward from inner surfaces thereof, and wherein the at least one conductive contact is a pair of conductive contacts sliding along the pair of positioning slots to be assembled to the insulative housing.

7. The electrical connector as claimed in claim 1, wherein the protection elements of the pair of conductive contacts locate close to each other.

8. The electrical connector as claimed in claim 7, wherein the contacting section of each conductive contact forms a contacting surface behind the tip end and the protection element, and wherein the contacting surface is a little higher than the protection element adapted for forming electrical connection with the complementary connector.

9. An electrical connector assembly comprising:

a first connector defining a mating direction and comprising:

a first insulative housing defining at least one first contact-receiving passage penetrating through the first insulative housing along said mating direction; and at least one first conductive contact received in the at least one first contact-receiving passage of the first insulative housing, the at least one first conductive contact comprising a first retention section interferentially received in the at least one first contact-receiving passage, a first mating section extending from the first retention section and forming a first tip end at a free end thereof;

a second connector comprising:

a second insulative housing defining at least one second contact-receiving passage penetrating through the second insulative housing along said mating direction; and at least one second conductive contact received in the at least one second contact-receiving passage of the second insulative housing and electrically connecting with the at least one first conducive contact, the at least one second conductive contact comprising a second retention section interferentially received in the at least one second contact-receiving passage, a second mating section extending from the second retention section and forming a second tip end at a free end thereof; and a protection element integrally formed with one of the first tip end of the first mating section and the second tip end of the second mating section to wrap one of the first tip end and the second tip end;

wherein the first connector comprises a pair of first conductive contacts received in said at least one first contact-receiving passage, and the second connector comprises a pair of second conductive contacts received in said at least one second contact-receiving passage.

10. The electrical connector assembly as claimed in claim 9, wherein the protection element is made from resin material and is insert-molded with one of the first tip end and the second tip end.

11. The electrical connector assembly as claimed in claim 10, wherein the protection element is integrally formed with one of the first insulative housing and the second insulative housing.

12. The electrical connector assembly as claimed in claim 9, wherein each first tip end is integrally formed with a protection element, and wherein the protection elements of the first conductive contacts are compressed by the second conductive contacts to contact each other.

13. The electrical connector assembly as claimed in claim 12, wherein each tip end has one of the configurations as: the tip end of the at least one conductive contact comprises any one of the configurations as: S-shape curved side edges, a pair of holes arranged along up-to-down direction, a recess extending along said mating direction, a pair of elongate slots arranged along said up-to-down direction, a wedge-shape slot extending rearward from a front edge thereof, and a T-shape bar at the front edge thereof.

14. An electrical connector adapted for electrically connecting with a complementary connector, comprising:

an insulative housing defining a mating direction and at least one contact-receiving passage extending along said mating direction;

at least one conductive contact received in said at least one contact-receiving passage adapted for electrically connecting with a conductive contact of the complementary connector, the at least one conductive contact comprising a retention section interferentially received in the at least one contact-receiving passage, and a mating section extending from the retention section adapted for electrically connecting with corresponding conductive contact of the complementary connector, and a mounting section extending from the retention section, the mating section forming a tip end at a free end thereof; and a protection element integrally formed with the tip end of the mating section of the at least one conductive contact and wrapping the tip end;

wherein the at least one conductive contact is of slice configuration, and wherein the retention section forms a plurality of barbs on upper and lower edges for interferentially engaging with inner walls of the at least one contact-receiving passage.

* * * * *